US010080453B2

(12) United States Patent
Stewart

(10) Patent No.: US 10,080,453 B2
(45) Date of Patent: Sep. 25, 2018

(54) LID WITH RETRACTABLE STRAW

(71) Applicant: Chef'n Corporation, Seattle, WA (US)

(72) Inventor: Joshua R. Stewart, Edmonds, WA (US)

(73) Assignee: Chef'n Corporation, Seattle, WA (US)

( * ) Notice: Subject to any disclaimer, the term of this patent is extended or adjusted under 35 U.S.C. 154(b) by 0 days.

(21) Appl. No.: 15/449,647

(22) Filed: Mar. 3, 2017

(65) Prior Publication Data

US 2017/0251851 A1 Sep. 7, 2017

Related U.S. Application Data

(60) Provisional application No. 62/304,094, filed on Mar. 4, 2016.

(51) Int. Cl.

| | |
|---|---|
| ***A47G 19/22*** | (2006.01) |
| ***B65D 55/16*** | (2006.01) |
| ***B65D 47/06*** | (2006.01) |

(52) U.S. Cl.

CPC ..... *A47G 19/2272* (2013.01); *A47G 19/2222* (2013.01); *A47G 19/2266* (2013.01); *B65D 47/066* (2013.01); *B65D 55/16* (2013.01); *B65D 2543/00046* (2013.01); *B65D 2543/00444* (2013.01)

(58) Field of Classification Search

CPC ..... A47G 19/2272; A47G 19/2266; A47G 19/2222; A47G 19/2205; B65D 47/066; B65D 47/065; B65D 47/06; B65D 55/16; B65D 51/18; B65D 77/28; B65D 77/283; B65D 43/169; B65D 47/265; B65D 47/243; B65D 47/241; B65D 47/24; B65D 43/20; B65D 43/12; B65D 90/58

USPC ..... 220/212, 254.3, 254.1, 709, 708, 707, 220/705, 345.4, 345.1; 215/229, 228; 222/561, 560, 559

See application file for complete search history.

(56) References Cited

U.S. PATENT DOCUMENTS

| | | | | |
|---|---|---|---|---|
| 4,485,963 A * | 12/1984 | Panicci | ..... | A47G 19/2266 215/229 |
| 5,203,468 A | 4/1993 | Hsu | | |
| 6,279,773 B1 * | 8/2001 | Kiyota | ..... | A47G 19/2266 220/709 |

(Continued)

FOREIGN PATENT DOCUMENTS

| | | |
|---|---|---|
| CN | 201942098 U | 8/2011 |
| JP | 60-20733 U | 2/1985 |
| JP | 2006-176184 A | 7/2006 |

*Primary Examiner* — Robert J Hicks

(74) *Attorney, Agent, or Firm* — Seed IP Law Group LLP

(57) ABSTRACT

A lid with a retractable straw for a cup or other fluid container is provided. The device includes a body including a cavity that extends from a bottom surface of the body to an upper surface of the body and a lid positionable between a closed position in which the lid lays on an upper surface of the body and an open position in which the lid is displaced from the upper surface of the body. The device also includes a tube, a straw and a mouthpiece. The mouthpiece coupled to the body and in fluid communication with the tube, the mouthpiece being positionable between a closed position in which the mouthpiece crimps the tube to the bottom surface of the body and an open position in which the tube couples the mouthpiece in fluid communication with the straw.

17 Claims, 10 Drawing Sheets

(56) References Cited

U.S. PATENT DOCUMENTS

| | | | | |
|---|---|---|---|---|
| 6,390,341 | B1 * | 5/2002 | Ohmi | B65D 47/0809 222/182 |
| 7,124,907 | B2 * | 10/2006 | Conaway | A47G 19/2266 220/254.1 |
| 7,516,862 | B2 * | 4/2009 | McDonough | A47G 19/2266 215/229 |
| 2005/0029271 | A1 * | 2/2005 | McDonough | A47G 19/2266 220/709 |
| 2009/0026218 | A1 | 1/2009 | Wong | |

* cited by examiner

LID WITH RETRACTABLE STRAW

BACKGROUND OF THE INVENTION

Field of the Invention

The present disclosure is generally related to liquid travel containers, and more particularly, to a lid with a retractable straw for a travel cup.

Description of the Related Art

Devices and methods for use in transporting and drinking liquids that resist spills, yet are easily openable, can aid in preventing spills. A variety of devices have been developed over the years in an attempt to reduce spills associated with traveling with liquids.

BRIEF SUMMARY OF THE INVENTION

The present disclosure is directed to devices and methods for use in transporting and drinking liquids. In one particular embodiment, a device includes a body including a cavity that extends from a bottom surface of the body to an upper surface of the body and a lid positionable between a closed position in which the lid lays on an upper surface of the body and an open position in which the lid is displaced from the upper surface of the body. The device can also include a tube, a straw and/or a mouthpiece. The mouthpiece can be coupled to the body and in fluid communication with the tube, and positionable between a closed position in which the mouthpiece crimps the tube and an open position in which the tube couples the mouthpiece in fluid communication with the straw.

BRIEF DESCRIPTION OF THE SEVERAL VIEWS OF THE DRAWING(S)

DETAILED DESCRIPTION OF THE INVENTION

The following detailed description is directed toward apparatus and methods for a lid with a retractable straw for a travel cup. The detailed description and corresponding figures are intended to provide an individual of ordinary skill in the art with enough information to enable that individual to make and use embodiments of the invention. Such an individual, however, having read this entire detailed description and reviewed the figures, will appreciate that modifications can be made to the illustrated and described embodiments, and/or elements removed therefrom, without deviating from the spirit of the invention. It is intended that all such modifications and deviations fall within the scope of the invention, and the invention is limited only by construction of following claims.

Reference throughout this specification to "one embodiment" or "an embodiment" means that a particular feature, structure or characteristic described in connection with the embodiment is included in at least one embodiment of the disclosed structures and/or methods. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
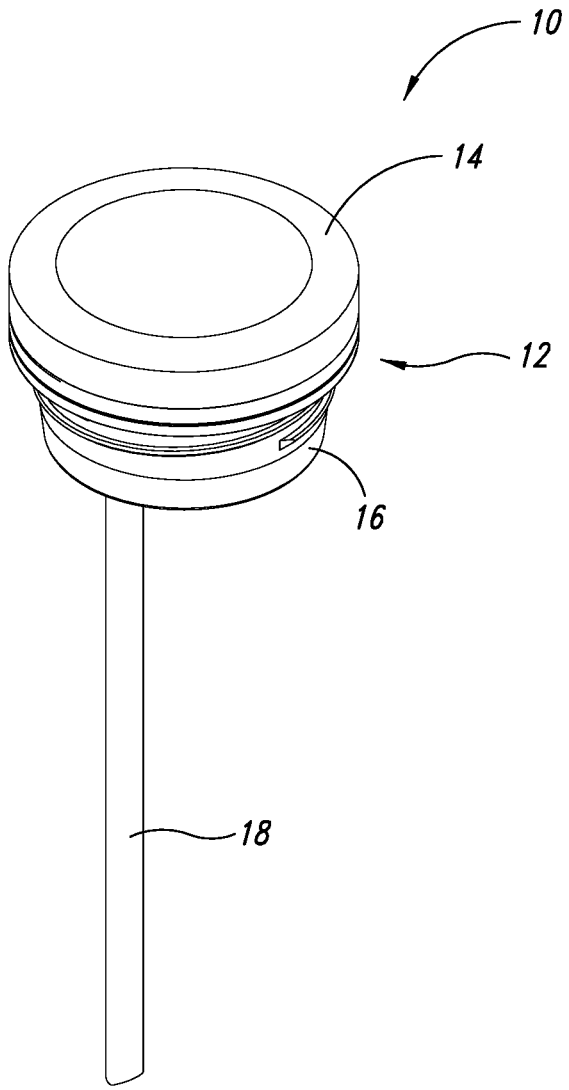
FIG. 1 is a top perspective view of a lid with a retractable straw, according to one embodiment of the present disclosure, with a lid in a closed configuration.

FIGS. 1-13 illustrate one particular embodiment of a device 10 for use in transporting and drinking liquids that resist spills and includes a retractable straw. FIG. 1 shows the device 10, which may be referred to as a lid for a cup, in a closed configuration. As shown in FIG. 1, the lid 10 includes a movable lid 14 coupled to a body 12.

A coupling 16 is provided at the lower portion of the body 12. The coupling 16 may facilitate coupling the body 12 of the device 10 to a fluid container such as the cup 100 shown in FIG. 12. A straw 18 is coupled to the body 12. When the device 10 is attached to a cup 100, the straw 18 extends towards the bottom the cup to aid in drinking fluid held within the cup. The straw 18 is fluidly coupled to a mouthpiece 20 (see, for example, FIG. 2) for drinking fluid from the cup.

The body 12 includes a central cavity 9 that extends from a bottom 17 of the body to an upper rim 19.

When the device 10 is in a closed configuration, as shown in FIG. 1, the mouthpiece 20 is retracted within the body 12 and covered by the lid 14. As discussed in greater detail below, when the device 10 is in the closed configuration with the mouthpiece 20 retracted, fluid flow between the straw 18 and the mouthpiece 20 is restricted to aid in preventing fluid from flowing through the mouthpiece 20.

Figure 2:
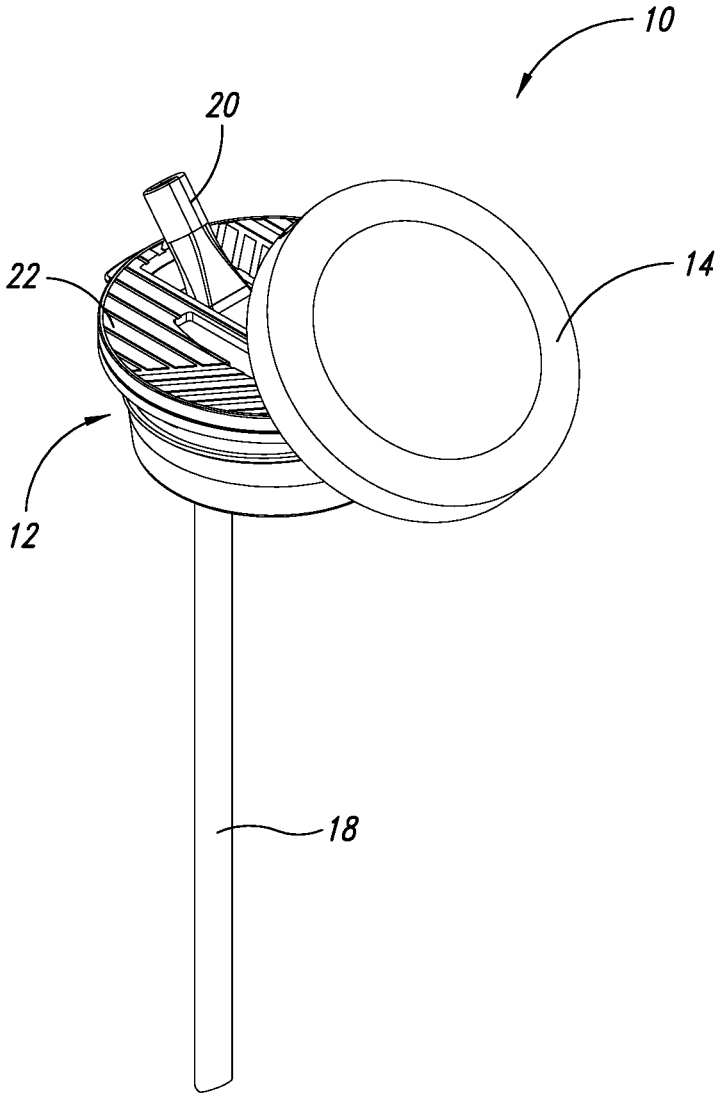
FIG. 2 is a top perspective view of the apparatus of FIG. 1 with the lid in a partially opened configuration.

FIG. 2 shows the device 10 in a partially opened configuration. As shown in FIG. 2, the lid 14 is rotated and moved away from the top portion 22 of the body 12. As also shown in FIG. 2, the mouthpiece 20, which was retracted and underneath the lid 14 in FIG. 1, is partially extended out from the top portion 22 of the body 12. When the lid is in the partially opened configuration or in the fully opened configuration (see, for example, FIG. 4) the mouthpiece 20 is in fluid communication with the straw 18 such that fluid is easily drawn through the straw 18 and out the mouthpiece 20.

Figure 3:
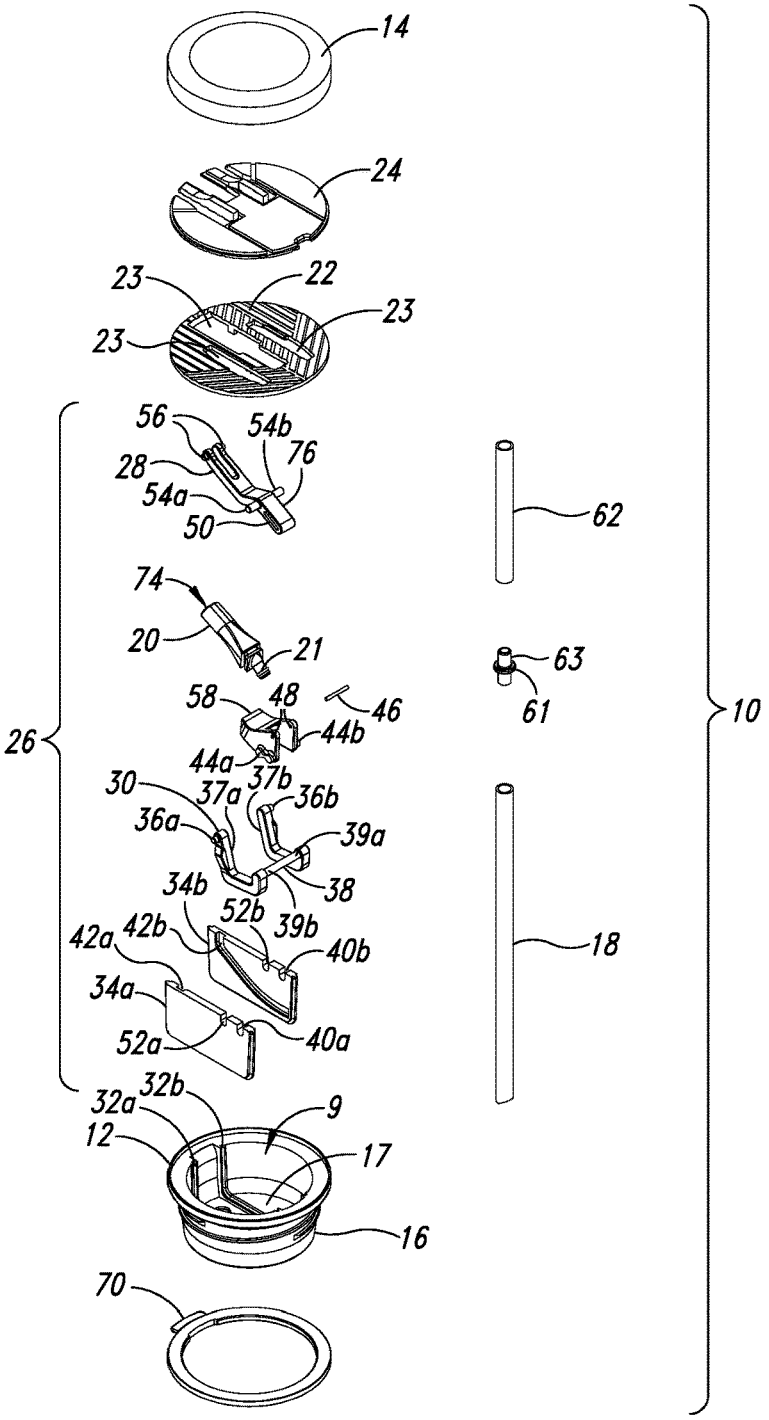
FIG. 3 is an exploded view of the components of the apparatus of FIG. 1.

FIG. 3 shows an exploded view of the device 10 and its constituent parts. A bottom cover 24 is attached to a bottom or inner side of the lid 14. The bottom cover 24 includes channels 25 that allow the various parts of a mouthpiece retraction mechanism 26 to pass through the bottom cover 24 and into one or more cavities on the underside of the lid 14. Similarly, the top portion 22 of the body 12 includes apertures 23 through which, for example, the mouthpiece 20 may extend and retract. Top portion 22, which may be a cover, is coupled to the top of the body 12 after assembly and installation of the mouthpiece retraction mechanism 26.

The mouthpiece retraction mechanism 26 includes a first linkage 28 and a second linkage 30 that, together with the lid 14, function to extend and retract the mouthpiece 20 when the lid 14 is moved between the open and closed configurations. The first linkage 28 is coupled to the lid 14 and the mouthpiece 20. Studs 56, at the first end of the first linkage 28, engage with corresponding apertures 72 on the underside of the lid 14. A slotted aperture 50 is located at the second end 76 of the first linkage 28. The slotted aperture 50 receives a pin 46. The pin 46 couples the first linkage 28 to the mouthpiece 20 via apertures 48,50 in the mouthpiece 20 and first linkage 28, respectively. The first linkage 28 pivots about the studs 54A, 54B that project outward from the sides of the linkage 28. When assembled, studs 54A, 54B engage with and rotate within slots 52A, 52B of side plates 34A, 34B.

The mouthpiece 20 includes a first end 74 by which a user receives fluid from the mouthpiece and a nipple 21 that couples to a flexible tube 62. The flexible tube 62 is held in place, in part, by a hose clamp, such as the hose clamp 58. The mouthpiece also includes a set of studs 44A, 44B that slidingly engaged with the tracks 42A, 42B of the side plates 34A, 34B.

The second linkage 30 includes a bar 38 with first and second ends 39A, 39B and first and second arms 37A, 37B that extend from the ends 39A, 39B of the bar 38. When assembled, the bar 38 engages with and rotates within the second set of slots 40A, 40B in the side plates 34A, 34B. The arms 37A, 37B include studs 36A, 36B that project from a distal end of the arms 37A, 37B. The studs 36A, 36B engage with corresponding apertures 73 within the lid 14. Thus, the lid 14 is coupled to both the first linkage 28 in the second linkage 30.

The side plates 34A, 34B engage with the body 16 via slots, such as slots 32A, 32B.

The device 10 may also include a gasket 70 that seals the outer perimeter of the body 16 to an upper perimeter of a cup. The gasket 70 provides a deformable interface between the relatively hard materials that make up the body 16 of the device 10 and the corresponding cup to which the device 10 is coupled.

The device 10 also includes the flexible tube 62, a coupling 60, and a second tube, such as the straw 18. A first end of the straw 18 is coupled to a first nipple 61 of the coupling 60 and a first end of the tube 62 is coupled to the second nipple 63 of the coupling 60. The coupling 60 may be hollow such that it couples the tube 62 in fluid communication with the straw 18. The coupling may be seated or otherwise fixed within an aperture 64 in the bottom surface 17 of the body.

Figure 4:
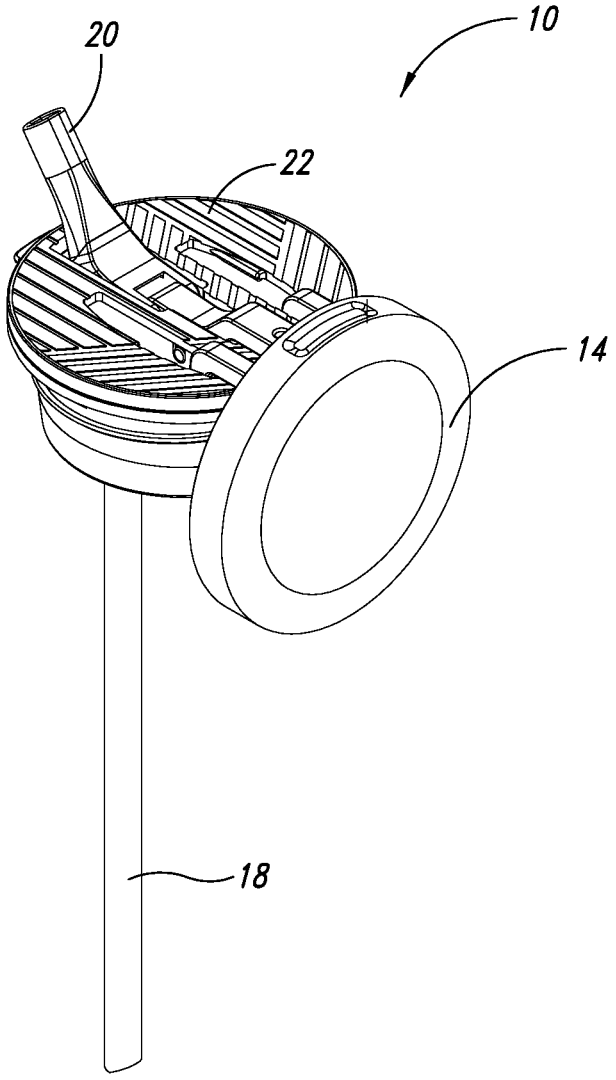
FIG. 4 is a top perspective view of the apparatus of FIG. 1 with the lid in a fully opened configuration.

FIG. 4 shows the device 10 in a fully opened configuration with the mouthpiece 20 fully extended and the lid 14 fully open and pivoted away from the upper surface 22.

Figure 5:
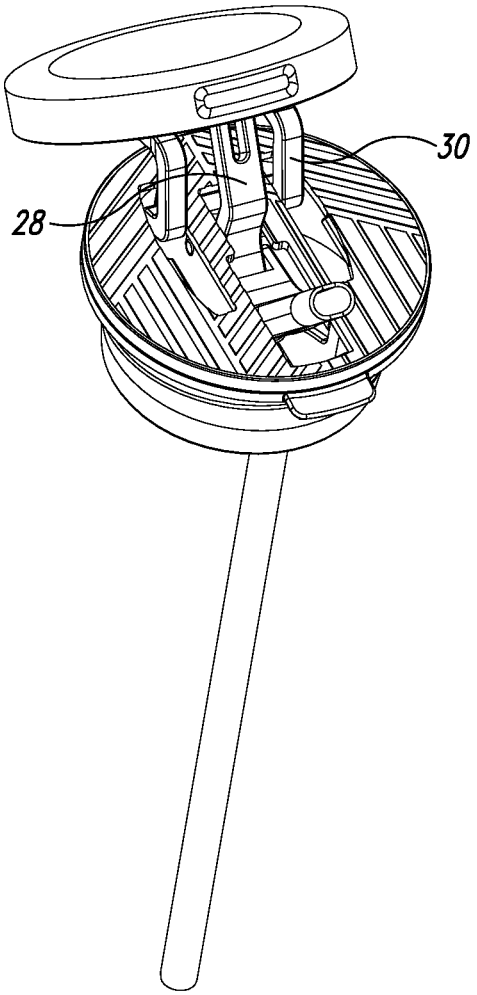
FIG. 5 is a top perspective view of the apparatus of FIG. 2.

FIG. 5 shows the device and a partially opened configuration similar to that shown in FIG. 2, but rotated to more clearly show how the linkages 28, 30 move with the lid 14 as the lid pivots from the closed configuration to the opened configuration.

Figure 6:
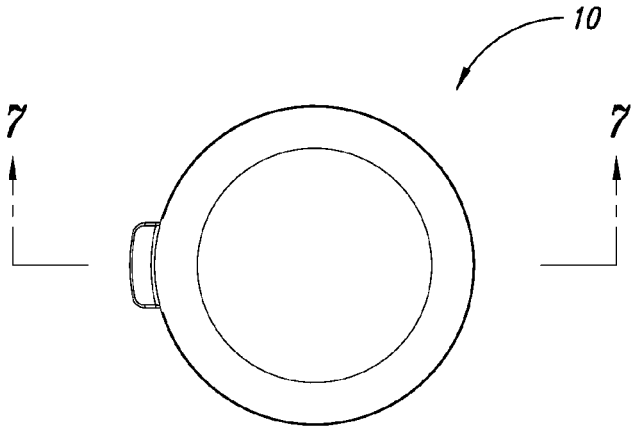
FIG. 6 is a top view of the apparatus of FIG. 1.
Figure 7:
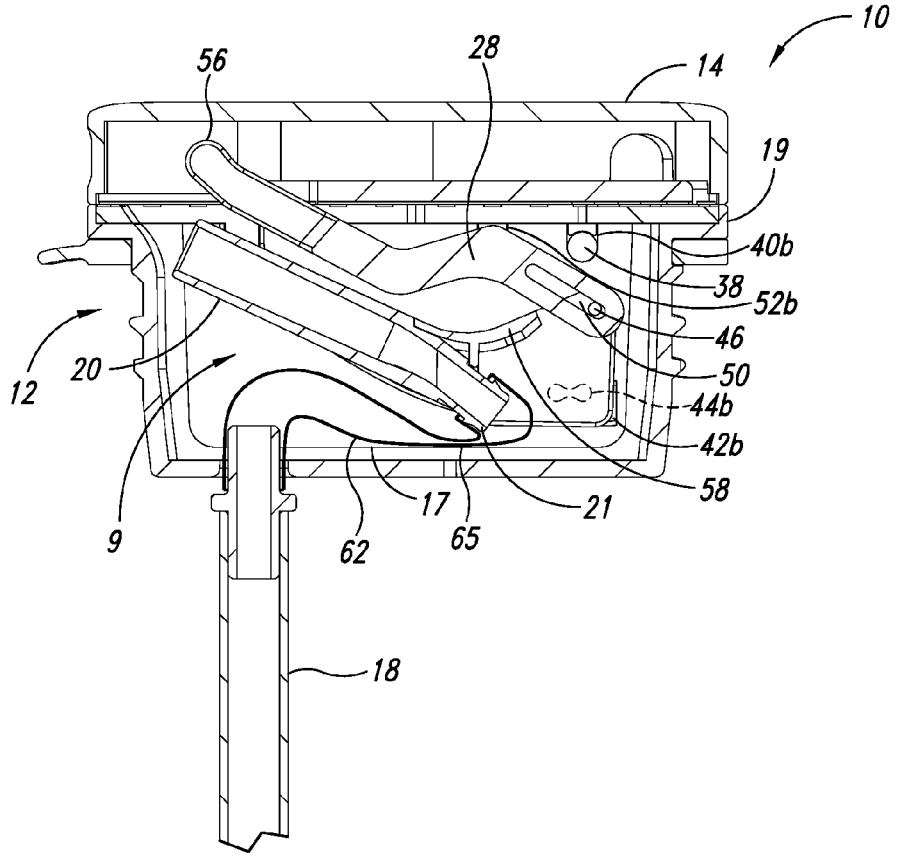
FIG. 7 is a cross-sectional view of the apparatus of FIG. 1 along Section 7-7 of FIG. 6.

FIG. 7 shows a cross-section of the device 10 along Section 7-7 of FIG. 6, in a closed configuration. The closed configuration of the device 10 will now be explained with particular attention to the configuration of the linkage 28 and the mouthpiece 20. In the closed configuration, the studs 56, at the first end of the linkage 28 are engaged with the lid 14 and the pin 46 is positioned at a distal end of the slotted aperture 50 at the second end of the linkage 28. The studs 44A, 44B are engaged with the tracks 42A, 42B at a lower first ends of the tracks 42A, 42B. The mouthpiece 40 is retracted within the cavity 9 of the body 12.

In this configuration, the nipple 21 of the mouthpiece 20 is retracted towards the bottom 17 of the body 12, causing a kink 65 to be formed in the tubing 62, where the nipple 21 presses the tubing 62 against the bottom 17 of the body 12.

Figure 8:
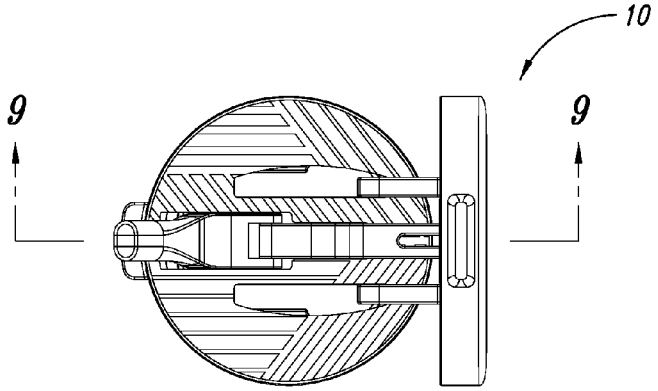
FIG. 8 is a top view of the apparatus of FIG. 4.
Figure 9:
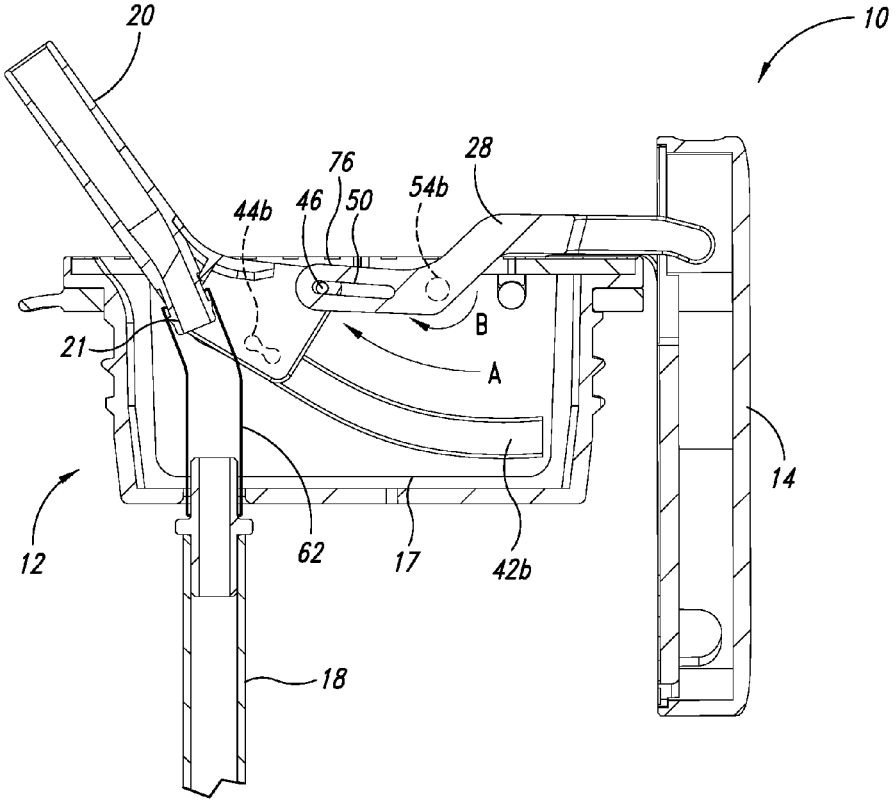
FIG. 9 is a cross-sectional view of the apparatus of FIG. 4, viewed along Section 9-9 of FIG. 8.

FIG. 9 shows a cross-section of the device 10 in an opened configuration, along Section 9-9 of FIG. 8. When the lid 14 moves from the closed configuration to the open configuration, the linkage 28 pivots about the studs 54A, 54B in a direction of rotation shown by arrow B. This rotation causes the mouthpiece 20 extend out from the body 12. As the linkage 28 rotates, the pin 46 rides within the slot 60 and imparts force onto the mouthpiece 20, causing the mouthpiece to move in a direction indicated by arrow A. The movement of the mouthpiece 20 is constrained by the studs 44A, 44B that are within the slotted tracks 42A, 42B. The studs 44A, 44B start at a lower first end of the tracks 42A, 42B in the closed position and slide along the path of the tracks 42A, 42B to an upper and of the tracks 42A, 42B when the lid 14 is in an open configuration. This causes the mouthpiece 20 extend outward from the body 12.

When the mouthpiece 20 is in the extended position, the nipple 21 no longer pins the flexible tube 62 against the bottom 17 of the body 12. This removes the kink 65, shown in FIG. 7, from the tube 62 and allows fluid to freely flow between the mouthpiece 20 and the straw 18.

Figure 10:
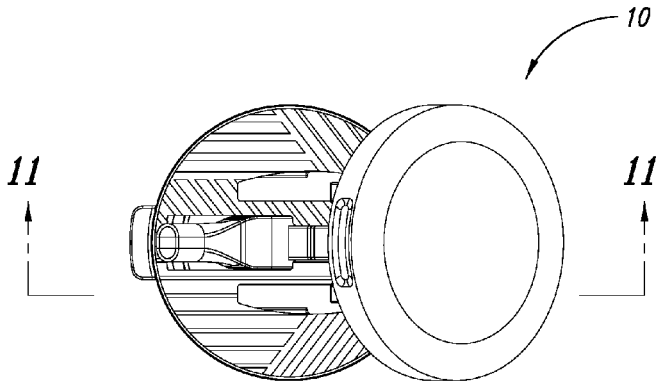
FIG. 10 is a top view of the apparatus of FIG. 2.
Figure 11:
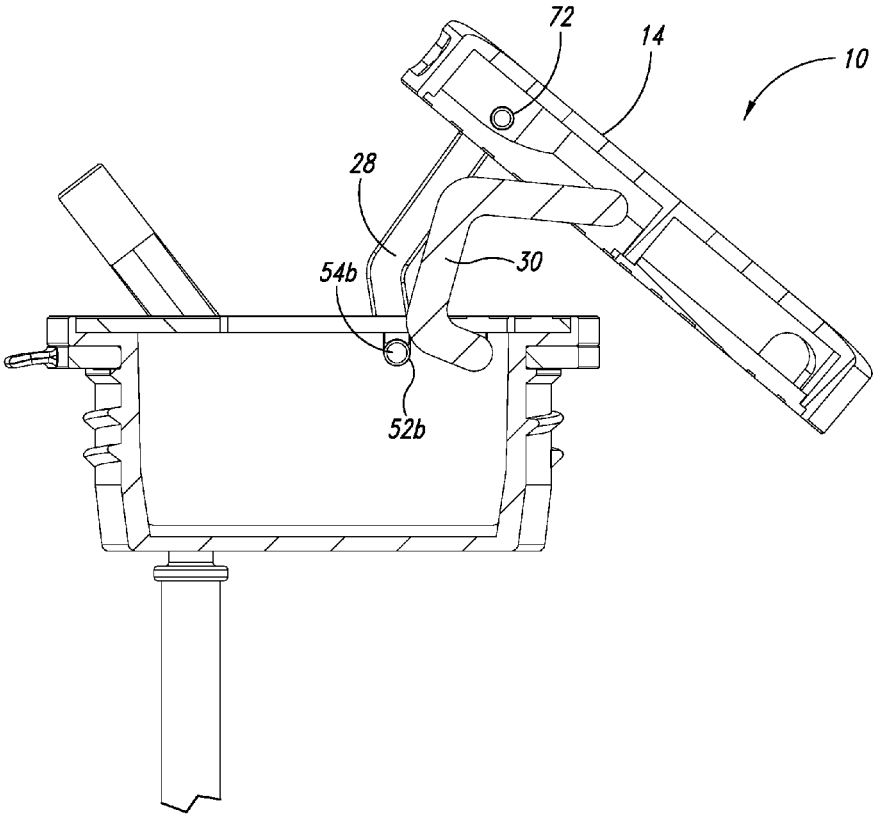
FIG. 11 is a cross-sectional view of the apparatus of FIG. 2, viewed along Section 11-11 of FIG. 10.
Figure 12:
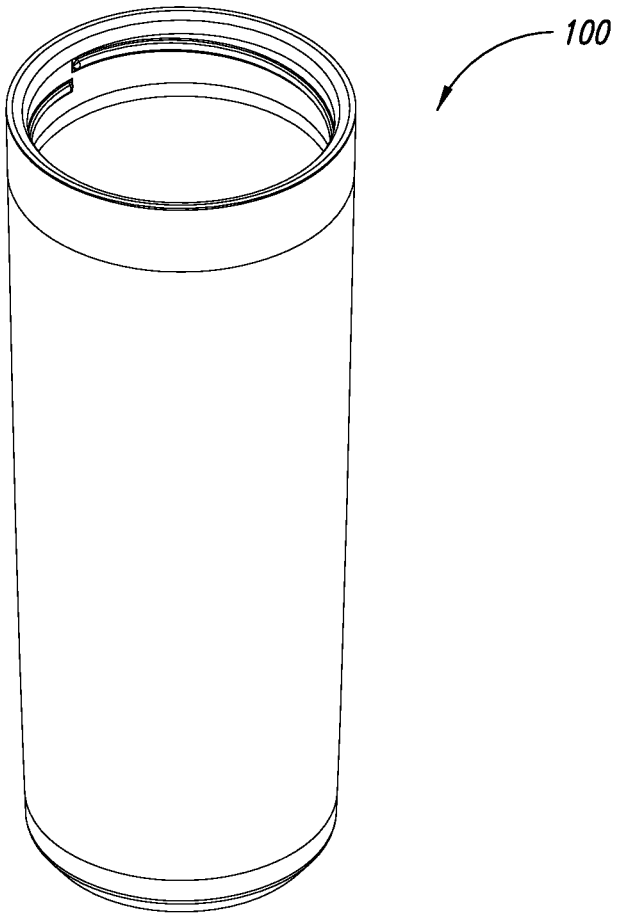
FIG. 12 is a top perspective view of a liquid container.
Figure 13:
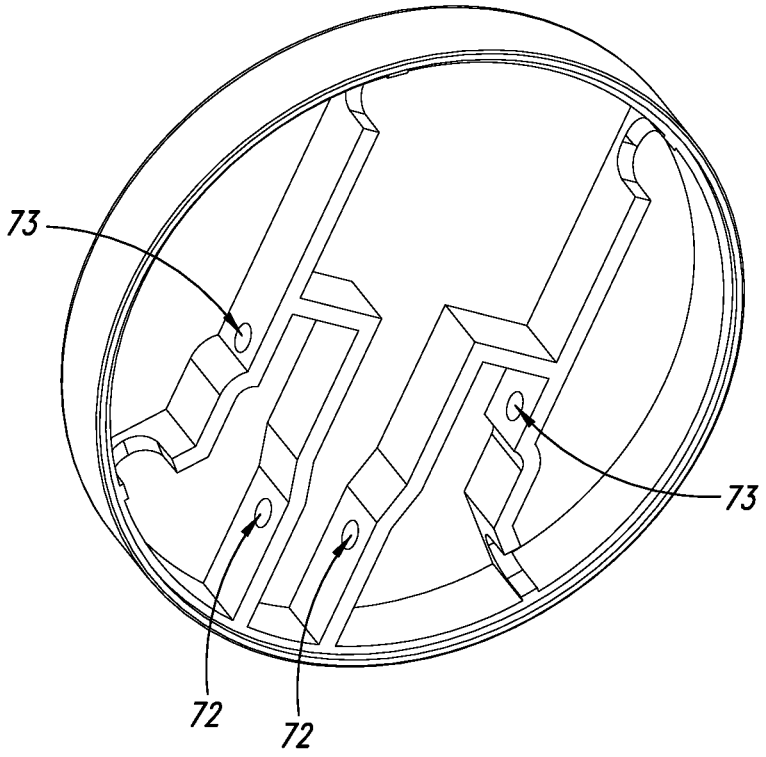
FIG. 13 is a bottom perspective view of a lid, according to one embodiment of the present disclosure.

FIG. 11 shows a cross-section of the device 10 along Section 11-11 of FIG. 10. In FIG. 11, the engagement between the stud 54B and the slot 52B of the sidewall 42B is more clearly shown. The engagement between the linkages 28, 30 and the lid 14 is also more clearly shown.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A device, comprising:

a body including a cavity that extends from a bottom surface of the body to an upper surface of the body;

a first sidewall;

a second sidewall, the first and second sidewalls disposed in the cavity of the body, each of the first and second sidewalls having respective tracks that define an arcuate path;

a lid positionable between a closed position in which the lid lays on the upper surface of the body and an open position in which the lid is displaced from the upper surface of the body;

a tube;

a straw;

a mouthpiece coupled to the body and in fluid communication with the tube, the mouthpiece being positionable between a closed position in which the mouthpiece crimps the tube to the bottom surface of the body and an open position in which the tube couples the mouthpiece in fluid communication with the straw, the mouthpiece travelling along the arcuate path defined by the tracks of the first and second sidewalls between the open position and the closed position.

2. The device of claim 1 further comprising:

a first linkage engaged with the first and second sidewalls and the mouthpiece.

3. The device of claim 2 further comprising:

a slotted aperture at a first end of the first linkage; and a pin that couples the mouthpiece to the first linkage through the slotted aperture.

4. The device of claim 3 further comprising:

studs projecting from opposite sides of the first linkage and engaged with a first set of slots in the first and second sidewalls, the first linkage rotatable about the studs.

5. The device of claim 4 further comprising:

a second linkage having first and second arms, each arm having a distal end engaged with the lid, the second linkage having a bar extending between proximal ends of the first and second arms, the bar being engaged with a second set of slots in the first and second sidewalls and configured to rotate about the bar when the lid is moved between the open position and the closed position.

6. The device of claim 2 wherein:

the tracks formed within the sidewalls extend between a lower end near the bottom of the body and an upper end near the upper surface of the body; and a set of studs projecting from the mouthpiece, each of the set of studs engaged with one of the tracks.

7. The device of claim 6 wherein, when the lid is translated from a closed position to an open position, the first linkage rotates about its studs, pushing the mouthpiece along the tracks and uncrimping the tube.

8. The device of claim 7 further comprising:

a fluid coupling that couples the straw and the tube in fluid communication.

9. The device of claim 8 further comprising:

an aperture though the bottom of the body, the fluid coupling seated in the aperture.

10. A method of forming a device, the method comprising:

coupling a lid to a body having a cavity;

coupling a straw to a tube;

coupling the tube to a mouthpiece;

positioning a first sidewall and a second sidewall in the cavity of the body, each of the first sidewall and the second sidewall having respective tracks that define an arcuate path; and coupling the mouthpiece to a linkage within the cavity, the linkage configured to aid in moving the mouthpiece between an open position and a closed position when the lid is moved between a corresponding open position and closed position, the mouthpiece traveling along the arcuate path defined by the tracks in the first sidewall and the second sidewall when the lid is moved between the open position and the closed position.

11. The method of claim 10, further comprising:

engaging the linkage with the first and the second sidewalls and the mouthpiece, the linkage having a slotted aperture at a first end of the linkage; and coupling the mouthpiece to the linkage through the slotted aperture via a pin, the pin slideably moveable through the slotted aperture between the open and the closed positions of the mouthpiece.

12. A device, comprising:

a body including a cavity that extends from a bottom surface of the body to an upper surface of the body;

a first sidewall;

a second sidewall, the first and second sidewalls disposed in the cavity of the body;

a lid positionable between a closed position in which the lid lays on the upper surface of the body and an open position in which the lid is displaced from the upper surface of the body;

a tube;

a straw;

a first linkage engaged with the first and second sidewalls and a mouthpiece, the first linkage having a slotted aperture at a first end of the first linkage;

a pin that couples the mouthpiece to the first linkage through the slotted aperture; and the mouthpiece coupled to the body and in fluid communication with the tube, the mouthpiece being positionable between a closed position in which the mouthpiece crimps the tube to the bottom surface of the body and an open position in which the tube couples the mouthpiece in fluid communication with the straw, the pin slideably moveable through the slotted aperture between the open and the closed positions of the mouthpiece.

13. The device of claim 12 wherein the first and the second sidewalls include respective tracks that define an arcuate path, the mouthpiece moveable between the open and the closed positions along the arcuate path.

14. The device of claim 12, further comprising:

a second linkage having first and second arms, each arm having a distal end engaged with the lid, the second linkage having a bar extending between proximal ends of the first and second arms, the bar being engaged with a set of slots in the first and the second sidewalls and configured to rotate about the bar when the lid is moved between the open position and the closed position.

15. A device, comprising:

a body including a cavity that extends from a bottom surface of the body to an upper surface of the body;

a first sidewall;

a second sidewall, the first and second sidewalls disposed in the cavity of the body;

a lid positionable between a closed position in which the lid lays on the upper surface of the body and an open position in which the lid is displaced from the upper surface of the body;

a tube;

a straw;

a first linkage engaged with the first and second sidewalls and a mouthpiece;

a second linkage having first and second arms, each arm having a distal end engaged with the lid, the second linkage having a bar extending between proximal ends of the first and second arms, the bar being engaged with a set of slots in the first and second sidewalls and configured to rotate about the bar when the lid is moved between the open position and the closed position; and the mouthpiece coupled to the body and in fluid communication with the tube, the mouthpiece being positionable between a closed position in which the mouthpiece crimps the tube to the bottom surface of the body and an open position in which the tube couples the mouthpiece in fluid communication with the straw.

16. The device of claim 15 wherein the first and the second sidewalls include respective tracks that define an arcuate path, the mouthpiece moveable between the open and the closed positions along the arcuate path.

17. The device of claim 15 wherein the first linkage includes a slotted aperture at a first end of the first linkage, the device further comprising:

a pin that couples the mouthpiece to the first linkage through the slotted aperture, the pin slideably moveable through the slotted aperture between the open and the closed positions of the mouthpiece.

* * * * *